United States Patent [19]

Frazita

[11] 4,187,480

[45] Feb. 5, 1980

[54] MICROSTRIP NETWORK HAVING PHASE ADJUSTMENT

[75] Inventor: Richard F. Frazita, Deer Park, N.Y.

[73] Assignee: Hazeltine Corporation, Greenlawn, N.Y.

[21] Appl. No.: 905,496

[22] Filed: May 12, 1978

Related U.S. Application Data

[62] Division of Ser. No. 783,237, Mar. 31, 1977, Pat. No. 4,117,494.

[51] Int. Cl.[2] ..... H01P 3/08; H01P 1/18; H01P 9/00

[52] U.S. Cl. ..... 333/161; 333/136; 333/246

[58] Field of Search ..... 333/31 R, 31 A, 84 M, 333/24.1, 97 R, 98 R, 156, 161, 164, 246; 324/58 R, 58 A, 58 B, 58 C, 58.5 R, 58.5 B

[56] References Cited

U.S. PATENT DOCUMENTS

| | | | |
|---|---|---|---|
| 3,136,946 | 6/1964 | Levine | 333/84 X |
| 3,566,311 | 2/1971 | Buck | 333/24.1 X |
| 3,599,121 | 8/1971 | Buck et al. | 333/24.1 X |
| 3,838,363 | 9/1974 | Schilz | 333/24.1 |

OTHER PUBLICATIONS

Huxley-"A Survey of the Principles and Practice of Waveguides", The MacMillan Co. 1947, New York; Title Page and pp. 145-146.

*Primary Examiner*—Paul L. Gensler
*Assistant Examiner*—Marvin Nussbaum

[57] ABSTRACT

In an array antenna system having a coupling network interconnecting a plurality of element groups, the coupling network is provided with phase adjustments to shift the angular location of the effective element radiation pattern. An effective technique for this phase adjustment in a microstrip coupling network makes use of a field altering structure positioned adjacent the microstrip.

2 Claims, 10 Drawing Figures

MICROSTRIP NETWORK HAVING PHASE ADJUSTMENT

CROSS REFERENCE TO RELATED APPLICATION

This application is a division of Ser. No. 783,237, filed Mar. 31, 1977, now U.S. Pat. No. 4,117,494 which issued Sept. 26, 1978 to the same assignee as the present case.

BACKGROUND OF THE INVENTION

In antenna systems such as that disclosed in the above-referenced patent a simple technique is required to enable phase adjustments to be made at several points in the antenna feed network. In addition, it is desirable that the technique selected lend itself to modular construction, which is a beneficial feature of that type of antenna. Finally it is necessary that the technique be easy to implement with mocrostrip transmission lines.

It is therefore, an object of the present invention to provide phase adjustable microstrip transmission line usable in phased array antennas.

SUMMARY OF THE INVENTION

The present invention relates to phase adjustable microstrip transmission line which comprises a ground plane, a dielectric substrate attached to said ground plane, a conductive strip attached to said substrate, and a conductive plate on the side of the strip away from the substrate and separated from the strip by a selected spacing. The conductive plate has a length in the direction of the strip which corresponds to an integral number of half wave lengths of a signal on the microstrip. This varies the fields of signals on the microstrip so as to adjust the transmission phase of the transmission line.

For a better understanding of the present invention, together with other and further objects, reference is made to the following description, taken in conjunction with the accompanying drawings, and its scope will be pointed out in the appended claims.

DESCRIPTION OF THE PREFERRED EMBODIMENT

Figure 1:
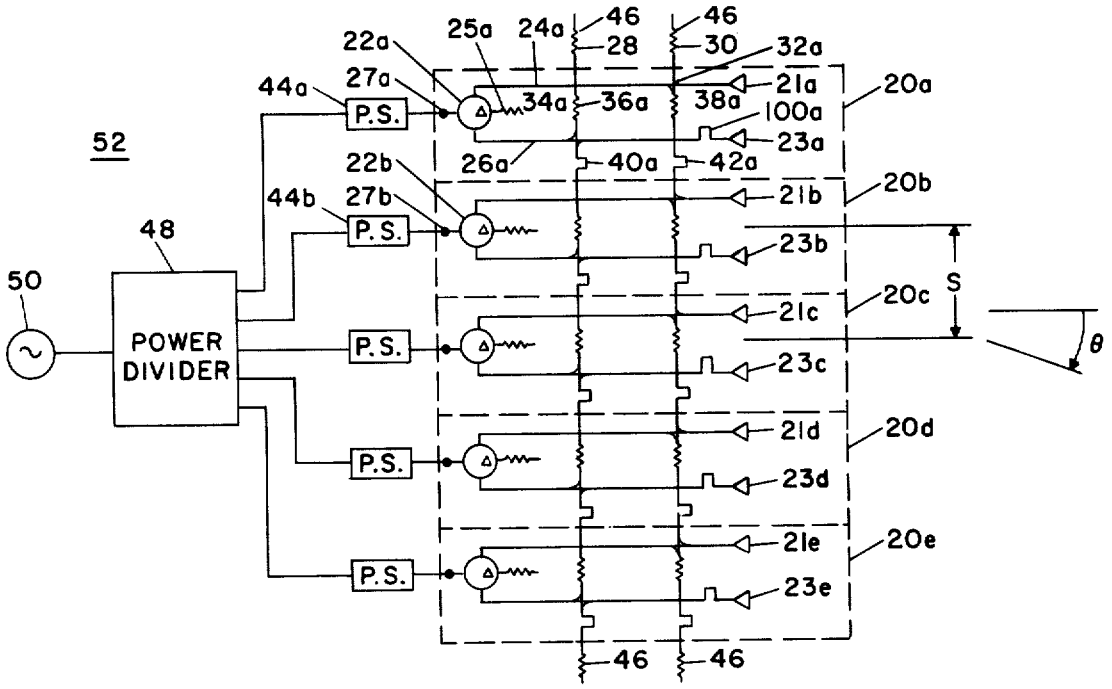
FIG. 1 is a schematic diagram of an antenna system in which the present invention is particularly useful.

FIG. 1 is a schematic diagram of an antenna system in which the present invention is particularly useful. The FIG. 1 antenna is constructed in accordance with the invention disclosed and claimed in U.S. Pat. No. 4,117,494 which issued Sept. 26, 1978, and is described more fully there. It is sufficient here to simply note that antennas of this type require phase adjustments 40, 42 and 100 in transmission lines 28, 30 and 26 associated with each of the element groups 20. Phase adjustments 40, 42 and 100 provide linear phase variation of the element aperture excitation without affecting the composite excitation in any other way, and therefor provide an angular shifting of the element pattern without changing the phase characteristics of the composite pattern resulting from the combination of all of the excitations provided to the inputs.

Figure 5:
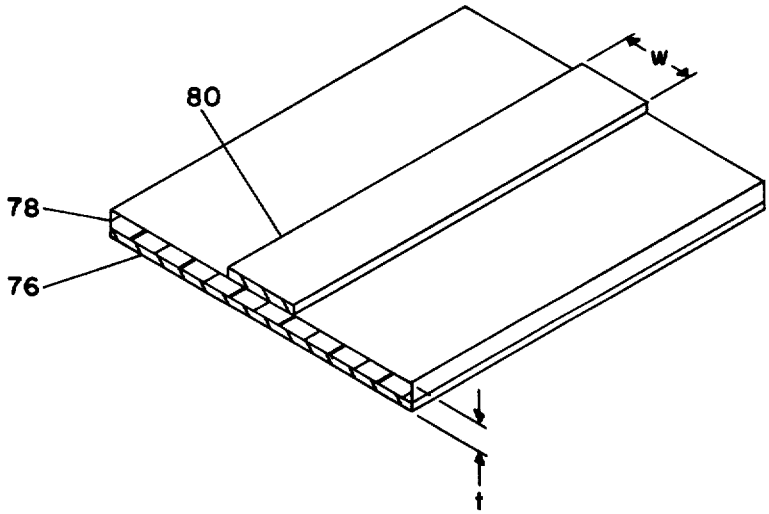
FIG. 5 is a cross-sectional perspective view of a microstrip transmission line.
Figure 6:
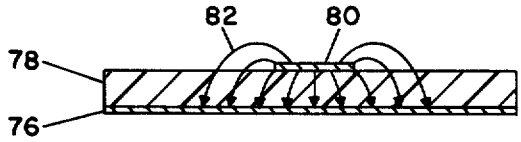
FIG. 6 is a cross-sectional view of the FIG. 5 transmission line.

The coupling networks of the FIG. 1 antenna, particularly interconnecting transmission lines 28 and 30, are advantageously formed using microstrip transmission line which is shown in FIG. 5. This transmission line includes a ground plane 76 over which there is a slab 78 of dielectric material. On the opposite side of dielectric slab 78 from ground plane 76, there is provided a conductive strip 80. Typically, ground plane 76 is a thin copper cladding on dielectric 78 and strip 80 is the remains of a similar cladding which has been largely removed by photoetching. Strip 80 and ground plane 76 form a two conductor transmission line whose impedance is determined by the thickness (t) and dielectric constant (k) of slab 78 and the width (w) of conductive strip 80. A typical 50 ohm transmission line may be formed using teflon-glass dielectric with a (k) of 2.2, a thickness (t) of 0.020 inches and having a conductive strip with a width (w) of 0.050 inches. FIG. 6 is a cross-sectional view of the transmission line shown in FIG. 5 and illustrates the electric fields associated with a typical wave energy signal. A small fringing portion of the field 82 passes through the air adjacent the conductive strip before entering the dielectric material.

The inventor has discovered that by providing a structure that acts upon and alters the fringing electric field 82, it is possible to adjust the phase of wave energy signals on the microstrip transmission line. In accordance with the invention, both positive and negative phase adjustments can be achieved depending on the type of field altering structure used. Thus, phase adjustments 40, 42 and 100 in FIG. 1 type antenna systems can be easily implemented.

Figure 7:
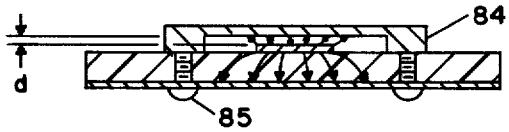
FIG. 7 is a cross-sectional view of a phase adjustable transmission line in accordance with the invention.

The cross-sectional view of FIG. 7 shows a field altering structure comprising conductive plate 84 which is arranged to be spaced a distance (d) from conductive strip 80. In order to accurately regulate spacing (d), conductive plate 84 has a cross-sectional configuration which includes a groove whose depth is selected in accordance with the required spacing (d). Screws 85 are provided to electrically connect conductive plate 84 to ground plane 76 of the transmission line.

Figure 3:
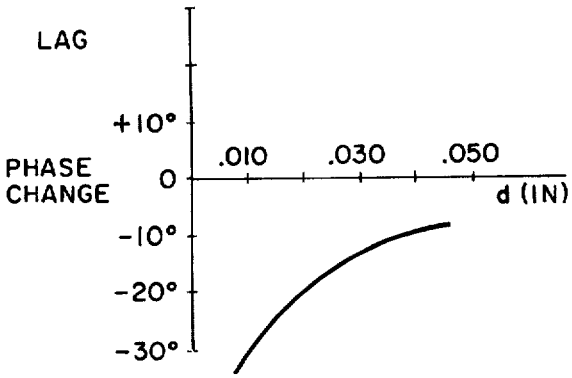
FIG. 3 is a graph showing phase as a function of separation (d) for the FIG. 9 transmission line.
Figure 10:
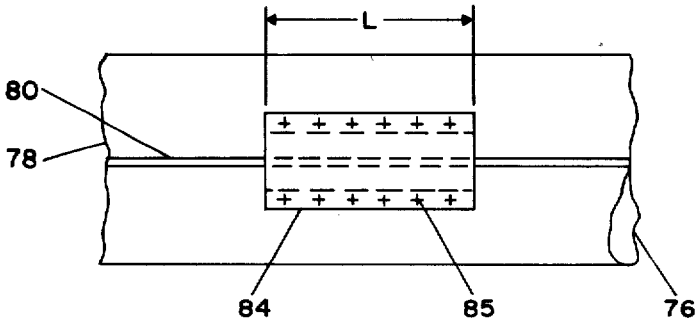
FIG. 10 is a planar view of the transmission line of FIG. 7.

Those skilled in the art will recognize that conductive plate 84 will draw some of the electric field emanating from conductive strip 80 through the region of air formed by the spacing (d) between conductive strip 80 and conductive plate 84. Since a major portion of the electric field will then be passing through air dielectric, the effective dielectric constant, and hence the propagation constant of the microstrip transmission line will be lower. It will also be recognized that as conductive plate 84 is arranged closer to conductive strip 80, the phase shifting effect will be increased. FIG. 3 is a graph showing an estimate of the phase shift at 5 GHz which might be realized by a conductive plate of the type shown in FIG. 7 with a length (L) of a half wave at the propagation constant of the transmission line. FIG. 10 is a planar view of such a conductive plate indicating the location of grounding screws 85 and the length (L) of the conductive plate.

Figure 4:
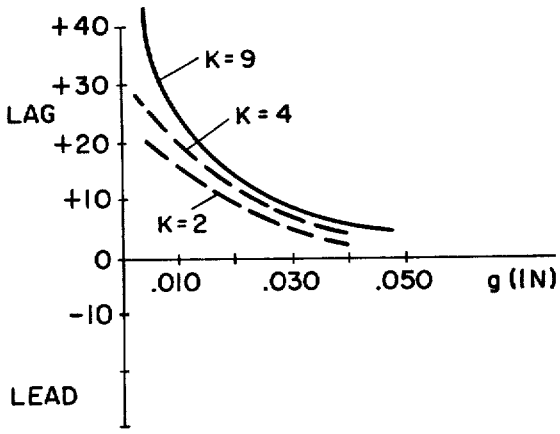
FIG. 4 is a graph showing phase as a function of separation (g) and dielectric constant for the FIG. 8 transmission line.
Figure 8:
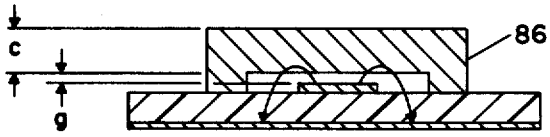
FIG. 8 is a cross-sectional view of another phase adjustable transmission line in accordance with the invention.
Figure 9:
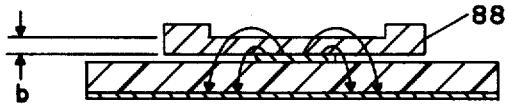
FIG. 9 is a cross-sectional view of another phase adjustable transmission line in accordance with the invention.

FIGS. 8 and 9 illustrate additional configurations wherein a field altering structure may be placed adjacent strip 80 to vary the propagation constant of the microstrip transmission line. In FIG. 8, a dielectric slab 86 of the same shape as conductive plate 84 is arranged with a spacing (g) away from conductive strip 80. Dielectric slab 86 intersects some of the fringing field from conductive strip 80 and since the slab has a higher dielectric constant than the air it replaces, there is an increase in the effective dielectric constant of the microstrip transmission line, and hence an increase in propagation constant. The effect of the FIG. 8 dielectric plate is therefore opposite the effect of the conductive plate of FIG. 7. The solid curve of FIG. 4 is a plot of measured phase shift at approximately 5 GHz, as a function of separation (g) for a half wave long plate of alumina which a thickness (c) of 0.125 inches, which has a dielectric constant (k) of 9. Also shown on the graph are the approximate phase shifts which would result from use of similar dielectric slabs with dielectric constants of 4 and 2. It is estimated that the effective phase shift is approximately proportional to $1/g\sqrt{k}$.

In FIG. 9, there is shown an alternate embodiment with a dielectric slab wherein the dielectric is placed in contact with conductive strip 80. In this event, phase adjustment may be achieved by trimming the thickness (b) of the dielectric slab 88.

Figure 2:
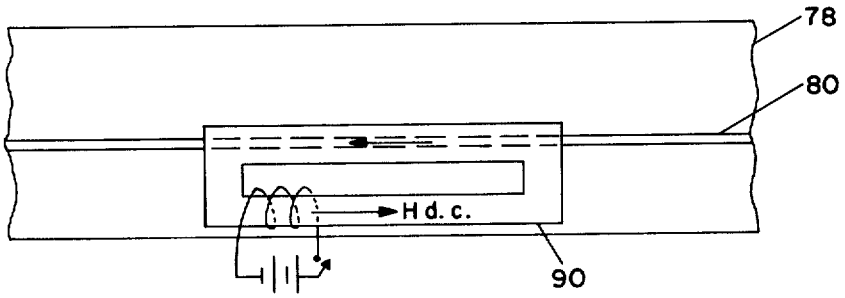
FIG. 2 is a planar view of phase adjustable transmission line in accordance with the invention.

FIG. 2 shows another phase adjustable microstrip. A toroidal shaped ferrite slab 90 is placed over conductive strip 80. By inducing a direct current magnetic field in the ferrite slab to alter the permeability of the ferrite it is possible to provide small changes in the propagation constant of the transmission line resulting in phase adjustment. If the ferrite has the toroidal shape illustrated, the configuration will be "latching" and will retain the d.c. magnetic field after the battery current is disconnected. The configuration of FIG. 2 may be particularly useful in the antenna network of FIG. 1, since the ferrite material may provide both the resistive loss and phase adjustment required in transmission lines 28 and 30.

It will be evident to those familiar with such transmission lines that it is advantageous to select the length (L) of the field altering structure to be equal to a half wave length or an integral number of half wave lengths, so that the signal reflections occuring at each end of the field altering structure will be approximately self-cancelling.

Those familiar with microwave circuits will recognize that the phase adjusting structure of FIGS. 2 and 7 through 10 may be used in cicuits other than that shown in FIG. 1. The structures are advantageously used in complex microstrip networks to trim out phase errors which may result from manufacturing tolerances and variations in dielectric materials or components.

While there has been described what are believed to be the preferred embodiments of the invention, those skilled in the art will recognize that other and further modifications may be made thereto without departing from the spirit of the invention, and it is intended to claim all such embodiments as fall within the true scope of the invention.

I claim:

1. A phase adjustable microstrip transmission line comprising:

a ground plane;

a dielectric substrate attached to said ground plane;

a conductive strip attached to said substrate; and a conductive plate on the side of said strip away from said substrate and separated from said strip by a selected spacing and having a length in the direction of said conductive strip which corresponds to an integral number of half wave lengths of a signal on said microstrip to thereby vary the fields of signals on said microstrip so as to adjust the transmission phase of said transmission line.

2. A transmission line as specified in claim 1 wherein said conductive plate is electrically connected to said ground plane.

* * * * *